United States Patent [19]

Griffith, III

[11] Patent Number: 4,967,969

[45] Date of Patent: Nov. 6, 1990

[54] APPARATUS FOR CHIPPING SOLID MATERIALS

[76] Inventor: Byron E. Griffith, III, P.O. Box 1802, Newman, Ga. 30264

[21] Appl. No.: 303,273

[22] Filed: Jan. 27, 1989

[51] Int. Cl.[5] ..... B02C 18/18

[52] U.S. Cl. ..... 241/93; 241/280; 241/294

[58] Field of Search ..... 241/293, 277, 294, 280, 241/281, 282, 30, 93, 225

[56] References Cited

U.S. PATENT DOCUMENTS

| | | | |
|---|---|---|---|
| 332,272 | 12/1885 | Miller | 241/225 |
| 713,270 | 11/1902 | Wynkoop | 241/93 |
| 2,710,635 | 6/1955 | Alexander | 241/280 X |
| 3,339,855 | 9/1967 | Dugle et al. | 241/280 |
| 3,509,924 | 5/1970 | Newhouse | 241/280 |
| 4,074,594 | 2/1978 | Dall et al. | 241/294 X |
| 4,351,484 | 9/1982 | Hart | 241/30 |

*Primary Examiner*—Mark Rosenbaum

*Attorney, Agent, or Firm*—Jones, Askew & Lunsford

[57] ABSTRACT

An apparatus for chipping solid materials generally comprises a chippr having a plurality of blades mounted between two hubs and spaced from one another and the shaft so that the chipped material does not jam the chipper. The blades preferably have a blade angle of from about 35 to about 60 degrees. An apparatus including the chipper, a device for support solid billets, and a conveyor for conveying the solid billets over the supporting device and into the chipper is also provided and advantageously occupies a minimum space.

29 Claims, 5 Drawing Sheets

10
12
15A
15B
21
30
53
56
57
58
59
62
63
65
68
70
72
74
76
77
80
81
85
88
91
94
97
100
103
106
109
110
113
120
123
124
127
128
140
143
147
150
177
183
186
189
192
195
198
201
204
207
220
229
235
236
248
256
268
271
275
285
288
290

APPARATUS FOR CHIPPING SOLID MATERIALS

TECHNICAL FIELD

The present invention relates generally to the chipping of billets of solid materials, and more particularly to the chipping of wax billets.

BACKGROUND OF THE INVENTION

Solid materials are often shipped and stored in chunks or billets for ease of handling of the solid materials. It is often necessary to break these billets of solid material into smaller pieces so that the solid material can be used most effectively and efficiently. For example, in some manufacturing processes it is necessary to melt solid materials to carry out the process. Billets of solid material are melted faster and more efficiently if the billets are broken into smaller pieces before being subjected to heat. Breaking the billets into smaller pieces increases the surface area of the solid material. This allows a greater area of the solid material to be instantly subjected to heat and thus increases the rate of heat transfer to the solid material.

Some solid materials are particularly difficult to break into smaller pieces. For example, solid materials having a wax-like consistency can cause processing problems when attempts are made to cut or shave the wax-like materials. Such materials are somewhat sticky and tend to adhere to and clog conventional cutters and shavers. Once cutters and shavers are clogged, the cutters and shavers are no longer effective and must be cleaned before effective operation can resume. The cleaning of clogged cutters and shavers can result in the loss of valuable processing time.

It is particularly desirable in certain processes for solid materials to be broken into smaller pieces and melted at the processing site rather than at a remote location. However, processing sites are often very crowded with equipment and there may not be much space for equipment to perform such tasks.

Smaller pieces of wax-like solids tend to agglomerate when they contact one another, thus, when billets of wax-like material are broken into smaller pieces and not immediately melted, the smaller pieces tend to agglomerate and reform a large solid block. This defeats the purpose of breaking the solid billets into smaller pieces. Further, if the solid material is melted at a location remote from the processing site, the melted material must then be transported under heated conditions to the processing site. This requires costly equipment and a large amount of energy.

Therefore, there is a need for an apparatus for breaking billets of solid material into smaller pieces which does not clog and which occupies a minimum space.

SUMMARY OF THE INVENTION

The present invention generally provides a chipper comprising a pair of hubs connected by a shaft. A plurality of blades are mounted between the two hubs and are spaced from one another along a circular periphery about the shaft. The circular periphery has a center through which the longitudinal axis of the shaft runs. Each blade has a cutting edge and a trailing edge opposite the cutting edge. The cutting edge of each blade projects beyond the circular periphery towards the trailing edge of another of the blades.

In operation, the chipper of the present invention is rotated about the longitudinal axis of the shaft and a solid billet is forced into the rotating blades. Each blade shaves a portion of the billet and as the blade shaves through the billet, the blade breaks the shaved portion of the billet into chips. These chips are rather small and tend to fall out of the chipper through the spaces between the blades. Therefore, the chipper does not tend to clog with the chipped pieces of the billet even when the billet comprises a somewhat sticky, wax-like material.

More specifically, the blades of the chipper of the present invention are positioned distal from the shaft so that there is a space between the blades and the shaft. Because there is a space between the blades and the shaft, the chips removed by the blades do not jam between the blades and the shaft; rather, the chips fall out of the chipper between the blades.

Even more specifically, each blade of the chipper comprises an elongated member having an outer side which meets a slanted side to form the cutting edge and a back side which meets the outer side opposite the cutting edge to form the trailing edge. The outer side of each blade faces outwardly from the shaft. The outer side of each blade faces outwardly from the shaft. The outer side and the slanted side of each blade meet to form an angle from about 35 degrees to about 60 degrees. With the angle of the blade from about 35 degrees to about 60 degrees, the blades tend to chip the shaved portions of the solid billet. When the cutting edge of the blade contacts the solid billet, the blade begins to shave into the billet. Then, as the blade makes its way through the billet, the blade acts as a wedge and chips the shaved portion of the billet off before the blade shaves through the entire billet. Thus, the blades of the chipper chip the solid billets into small pieces which are less likely to clog the chipper.

Still more specifically, the blades of the chipper have a plurality of linear grooves in the outer side running between the cutting edge and the trailing edge and spaced from one another along the outer side. These grooves tend to break the chipped portions of the billet into even smaller pieces as the blades cut into the billets.

Even more specifically, the trailing edge of each blade also projects beyond the circular periphery of the chipper. The cutting edge of each blade is positioned further from the longitudinal axis of the shaft of the chipper than the trailing edge. Thus, the cutting edge projects slightly further form the circular periphery of the chipper than the trailing edge. This differential between the cutting edge and the trailing edge of the blades of the cutter is particularly advantageous as will be discussed further hereinbelow.

The present invention further provides an apparatus which includes the chipper of the present invention and a device for supporting the solid billets and a conveyor for delivering billets over the supporting means and into the chipper. The apparatus of the present invention may also include a device for holding the billets down against the support device as the billets are conveyed into the chipper. The apparatus of the present invention further provides a magazine which houses a stack of billets and feeds the billets to the conveyor.

During operation of the apparatus of the present invention, the conveyor carries billets from the magazine to the support device and into the chipper. The chipper rotates and chips the billets into smaller pieces as previously described. As the cutting edge of each blade cuts completely through the billet, the trailing edge of the blade, which extends from the circular periphery of the chipper slightly less than the cutting edge, pushes the billet slightly backward onto the support device as the following blade cuts into the billet. This is particularly advantageous when the last sliver of the billet reaches the cutter. The trailing edge of each blade holds the last sliver of the billet onto the supporting device until the last sliver is small enough to be chopped by the following blade without jamming the chipper.

Therefore, it is an object of the present invention to provide an apparatus for chipping billets of solid material.

Another object of the present invention is to provide an apparatus for chipping billets of solid wax-like material that does not become clogged with the wax-like material.

Another object of the present invention is to provide an apparatus for chipping billets of solid material which occupies a minimum space.

Other objects, features, and advantages will become apparent from reading the following specifications in conjunction with the accompanying drawings.

DETAILED DESCRIPTION

Figure 1:
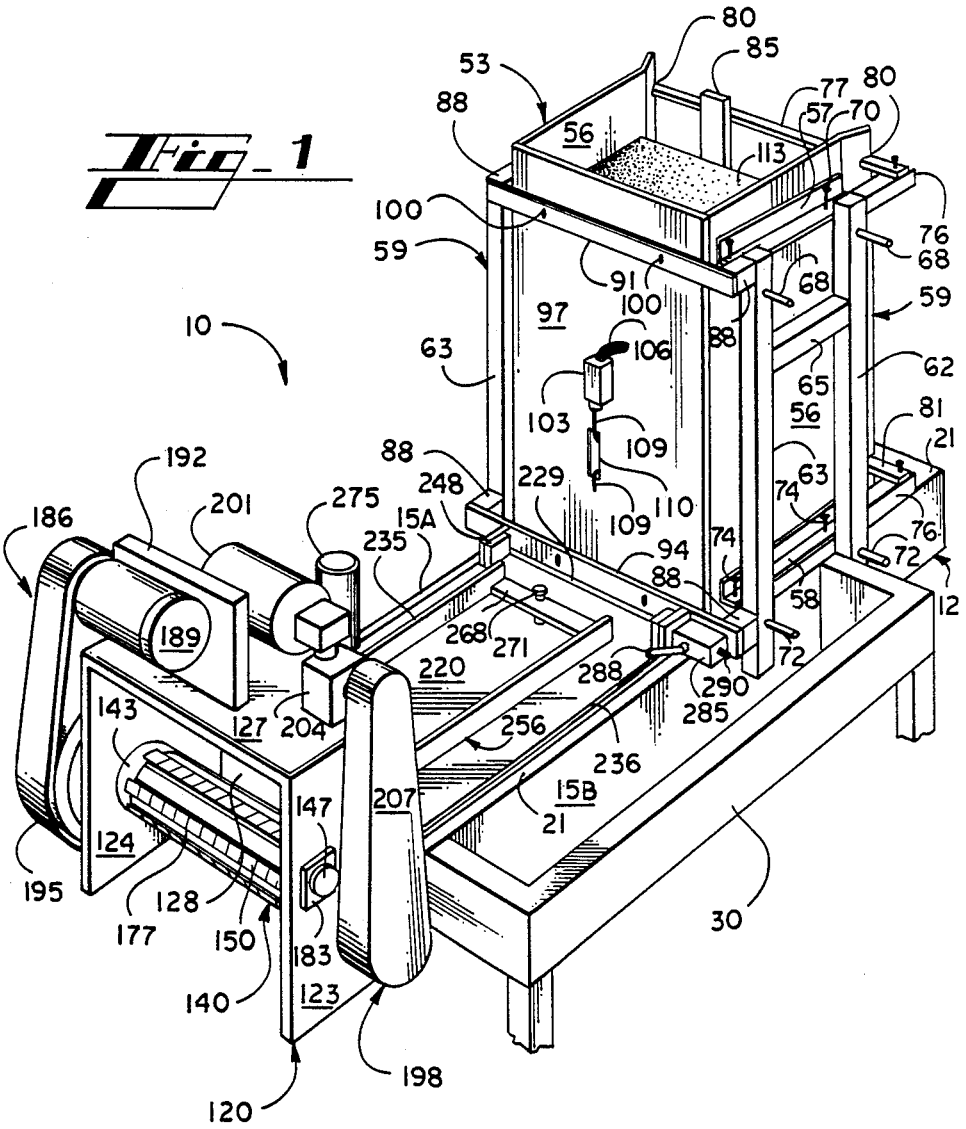
FIG. 1 is a perspective view of the preferred embodiment of the present invention.
Figure 2:
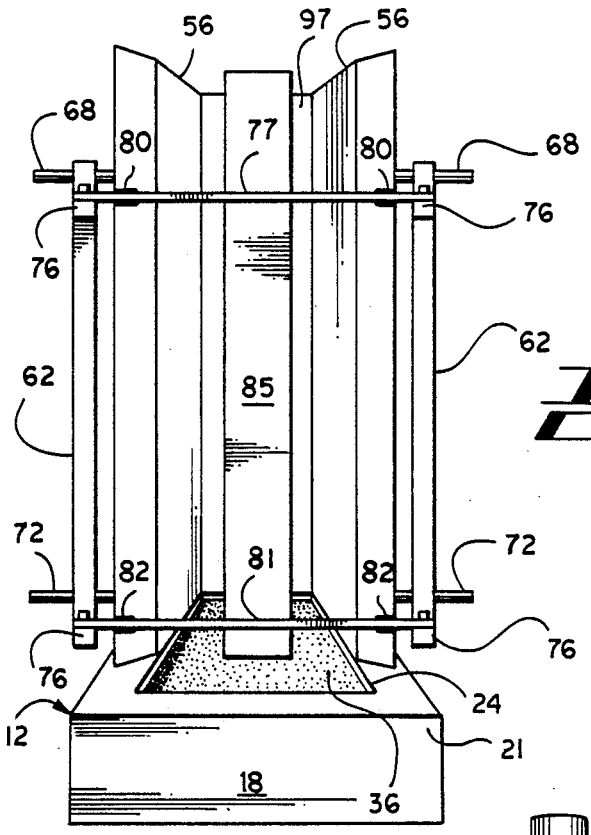
FIG. 2 is a fragmentary perspective view of the preferred embodiment illustrating the magazine.

Turning first to FIGS. 1 and 2, a chipping apparatus 10 is shown. The chipping apparatus 10 comprises an elongated conveyor housing 12 which includes side panels 15A and 15B connected by a rear panel 18 and a top panel 21. The top panel 21 includes an elongated rectangular opening 24 which extends from the rear of the top panel to the forward end of the top panel. The conveyor housing 12 is supported by a stand 30 partially shown in FIG. 1.

Figures 3A, 3B:
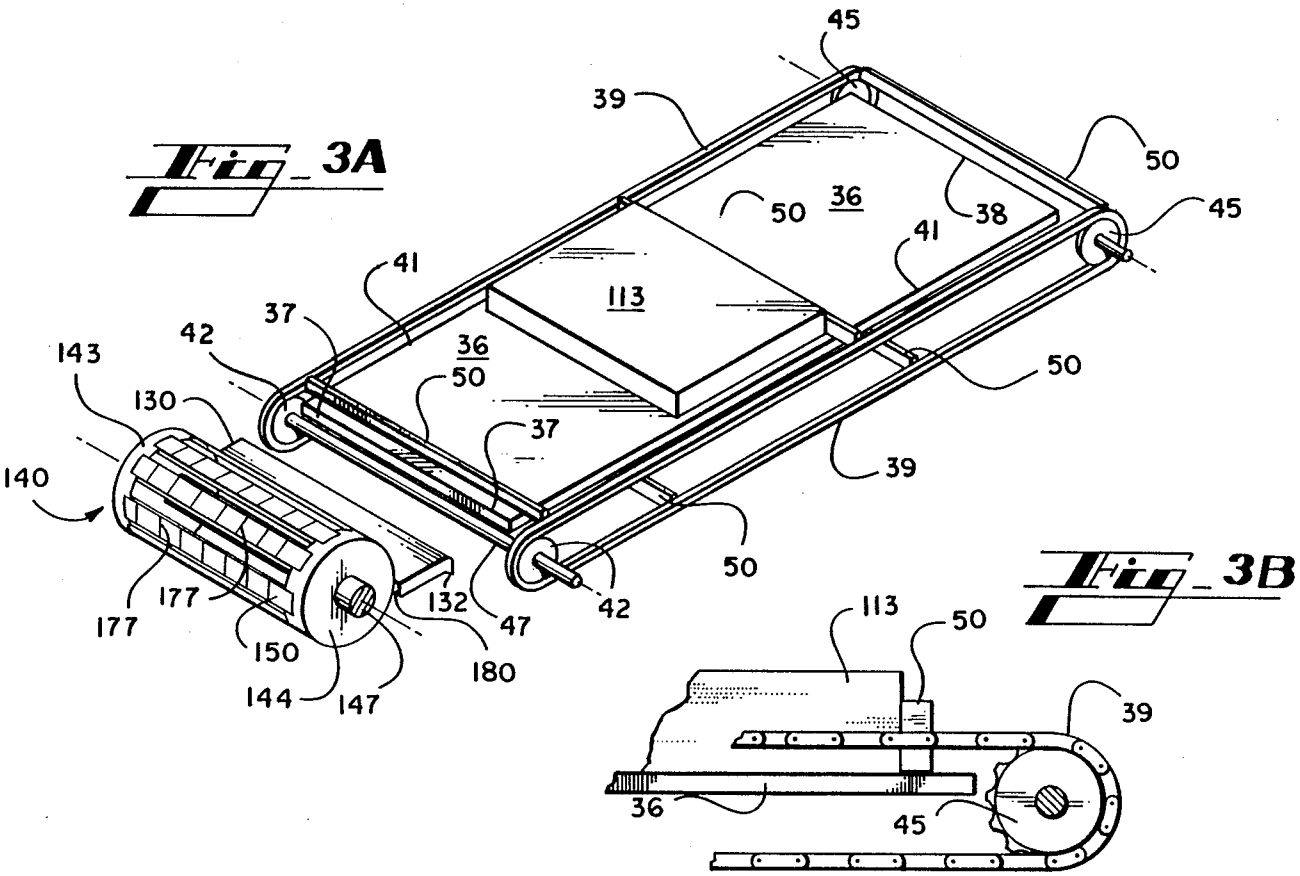
FIG. 3A is a fragmentary perspective showing the slider bed conveyor and the chipper of the preferred embodiment.
FIG. 3B is a sectioned side elevation view of the flight bar and chain assembly of the preferred embodiment.

As best shown in FIG. 3A, a planar elongated rectangular slider bed 36 having a forward edge 37, a rearward edge 38, and side edges 41, fits within the conveyor housing 12 below the top panel 21 and is mounted along each side to angle irons which are welded to each side panel 15A and 15B within the conveyor housing. Two chains 39 run along each side 41 of the slider bed 36 within the conveyor housing 12. Each of the chains 39 form an endless loop and fit around drive sprockets 42 rotatably mounted through the front end of each side panel 15A and 15B of the conveyor housing 12 and idler sprockets 45 rotatably mounted through the rear end of each side panel of the conveyor housing. The upper portion of each chain 39 runs the length of the slider bed 36 between the slider bed and the top panel 21. The chains 39 are shown in FIG. 3B as double pitch chains; however, single pitch chains may be preferred when smaller sprockets are used. The lower portion of each of the chains 39 runs below the slider bed 36. The drive sprockets 42 are connected by a shaft 47 for synchronous operation. Flight bars 50 are connected to and extend between the chains 39 across the slider bed 36. It is preferable to use a plurality of flight bars spaced from one another along the length of the chains 39. However, it should be understood that only one flight bar is necessary for operation of the chipping apparatus 10 and the number of flight bars used depends on the size of the billets being processed, the length of the slider bed 36, and the rate of chipped product desired.

As best shown in FIGS. 1 and 2, a billet magazine 53 is mounted to the rearward portion of the conveyor housing 12 and extends upwardly from the top novel 21 above the rectangular opening 24. The magazine 53 comprises two rectangular side panels 56 positioned opposite one another along each side of the rectangular opening 24. A first angle iron 57 extends laterally across the upper portion of each of the side panels 56 and is fixed thereto. A second angle iron 58 extends laterally across the lower portion of each of the side panels 56 and is also fixed thereto.

Each side panel 56 is removably mounted to magazine supports 59 on each side of the conveyor housing 12. Each magazine support 59 comprises a pair of vertical posts 62 and 63 spaced parallel to one another and welded at the lower end to the respective side panel 15A and 15B proximate the rear end of the conveyor housing 12 and extending upwardly from the conveyor housing 12. A stabilizing bar 65 extends between each pair of vertical posts 62 and 63 near the upper ends of the vertical posts. Shafts 68 extend through the top of each of the vertical posts 62 and 63 of the magazine supports 59 towards the respective side panels 56 and fit beneath the first angle irons 57. Bolts 70 fit through holes in the first angle irons 57 and screw into the end of the shafts 68 adjacent the side panels 56 to secure the side panels to the magazine supports 59. Additional shafts 72 extend through each of the vertical posts 62 and 63 proximate the bottom of each of the side panels 56 and extends towards the respective side panels 56 and fit beneath the second angle irons 58. Bolts 74 fit through holes in the second angle irons 58 and screw into the ends of the shafts 72 adjacent the side panels 56 to further secure the side panels to the magazine supports 59.

Support arms 76 extend rearwardly from the rearward vertical posts 62 of each magazine support 59 proximate the top and bottom of the side panels 56. As best shown in FIG. 2, a first rear panel support bar 77 extends between the support arms 76 proximate the top of the side panels 56 through slots 80 in the rearward edge of each of the side panels. A second rear panel support bar 81 extends between the support arms 76 proximate the lower end of the side panels 56 through additional slots 82 in the rearward edge of the side panels. A narrow rectangular rear panel 85 is welded to the first and second rear panel support bars 77 and 81.

Supports arms 88 extend forwardly from the forward vertical posts 63 of each magazine support 59 proximate the top and the bottom of the side panels 56. A first front panel support bar 91 extends between the support arms 88 positioned proximate the top of the side panels 56 and a second front panel support bar 94 extends between the support arms positioned proximate the lower portion of the side panels. A rectangular front panel 97 is mounted to the first and second front panel support bars 91 and 94 with bolts 100 and extends between the side panels 56 of the magazine 53 to form a substantially box-shaped magazine. The bolts 100 fit through slots which allow for vertical adjustment of the front panel 97.

A whisker switch 103, which is well known to those of ordinary skill in the art, is mounted to the front panel 97 and is connected to a control box (not shown) through an electrical cord 106. A wire 109 extends from the bottom of the switch 103 and into the magazine 53 through a slot 110 in the front panel 97. When the magazine 53 is loaded with billets 113 as in FIG. 1, the wire 109 is forced outwardly by the billets and the switch 103 is turned off. When the billets 113 in the magazine 53 drop to a level below that of the wire 109, the wire 109 drops back against the front panel 97 and the switch 103 is turned on. When the switch 103 is turned on, a signal is sent to the control box that the magazine 53 needs to be reloaded with billets 113.

Figure 4A:
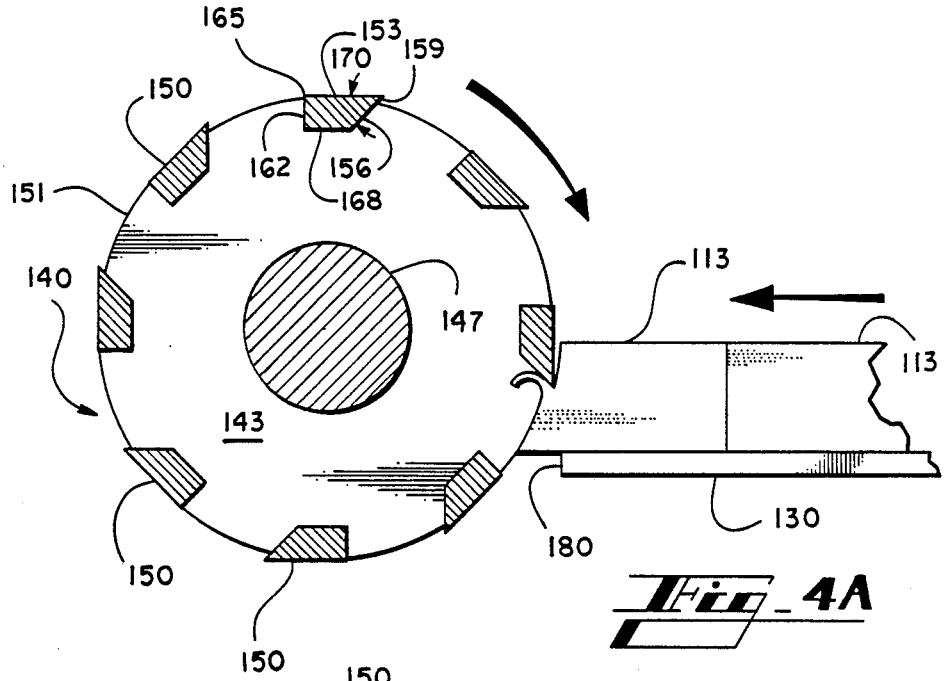
FIG. 4A is a sectioned side elevation view of a preferred embodiment of the chipper showing the operation of the chipper.
Figure 4B:
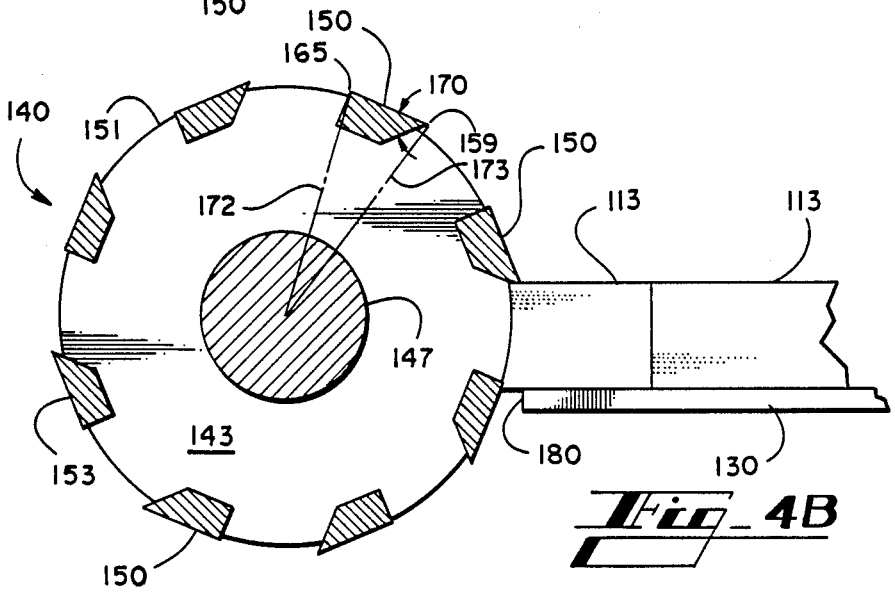
FIG. 4B is a sectioned side elevation view of a preferred embodiment of the chipper showing the operation of the chipper.

A chipper housing 120 is welded to the end of the conveyor housing 12 distal from the magazine 53. The chipper housing 120 comprises two side panels 123 and 124 fixed to the conveyor frame 12 and extending upwardly. A top panel 127 connects the top edges of the side panels 123 and 124. A vertical rectangular shield 128 fits within the chipper housing 120 between the side panels 123 and 124 spaced from the conveyor housing 12. A rectangular dead plate 130, shown in FIGS. 3A, 4A, and 4B, is mounted within the chipper housing 120 on angle irons which are welded to each of the side panels of the chipper housing. The dead plate 130 is positioned in planar alignment with the slider bed 36. The rearward edge 132 of the dead plate 130 is spaced from the forward edge 37 of the slider bed 36 so that the flight bars can pass between the dead plate and the slider bed. The dead plate 130 curves slightly downwardly towards the rearward edge 132 so that the billets 113 are not caught on the rearward edge of the dead plate as they pass from the slider bed 36 to the dead plate. The dead plate 130 is removably mounted to the angle irons welded to the side panels 123 and 124 with bolts.

As shown in FIGS. 3A, 4A, and 4B, the chipper 140 comprises a pair of cylindricals hubs 143 and 144 which oppose one another and are connected by a shaft 147 which runs through holes in the center of each hub. The shaft 147 has a longitudinal axis which is substantially aligned with the axes of the hubs 143 and 144. The shaft 147 extends outwardly from each of the hubs 143 and 144. A plurality of blades 150 extend between the hubs 143 and 144. As shown best in FIGS. 4A and 4B, each of the blades 150 comprises an elongated member having an outer side 153 which meets a slanted side 156 to form a cutting edge 159 and a back side 162 which meets the outer side opposite the cutting edge to form a trailing edge 165. Each blade 150 also includes a flat bottom side 168 opposite the outer side 153.

As shown in FIGS. 4A and 4B, the outer side 153 of each blade 150 meets the slanted side 156 to form an angle at 170 of 45 degrees; however, it should be understood that the angle between the outer side and the slanted side of the blades may be from about 30 degrees to about 60 degrees depending on the type of material being chipped. An angle of 45 degrees is more effective for chipping billets of wax. Angles greater than 45 degrees are preferable when chipping more brittle materials and angles less than 45 degrees are preferable when chipping softer materials.

The blades 150 are preferably mounted in notches in the hubs 143 and 144 and secured to the hubs with countersunk bolts. By mounting the blades 150 in the notches, the thrust of the load taken by the blades during operation of the chipper 140 is taken by the hubs 143 and 144. The blades 150 are preferably spaced equidistant from one another about the circular periphery 151 of the hubs 143 and 144. The blades 150 are also preferably spaced from the shaft 147. The chipper 140 shown in the preferred embodiment comprises a total of eight blades, however, it should be understood that any number of blades can be mounted about the hubs provided the blades are sufficiently spaced apart to allow the chipped material to fall between the blades during operation of the chipper.

The blades 150 are preferably mounted between the hubs 143 and 144 so that the outer side 153 of each of the blades is positioned tangentially to the circular periphery 151 of each of the hubs. The cutting edge 159 of each of the blades 150 extends slightly outwardly from the circular periphery 151 of the hubs 143 and 144 towards the trailing edge 165 of another of the blades. The trailing edge 165 of each of the blades 150 also extends beyond the circular periphery of the hubs 143 and 144; however, the cutting edge 159 of each of the blades is preferably positioned slightly farther from the longitudinal axis of the shaft 147 than the trailing edge of the blades as illustrated by lines 172 and 173 in FIGS. 4B.

The blades 150 of the chipper 140 also have a plurality of grooves 177 which run between the cutting edge 159 and the trailing edge 165 along the length of the blades. The grooves 177 cut the material being chipped into smaller pieces to further reduce the likelihood of chipped material jamming the chipper 140.

The chipper 140 is mounted between the side panels 123 and 124 of the chipper housing 120 proximate the forward edge 180 of the dead plate 130. The shaft 147 of the chipper 140 fits through cylindrical bearings 183 bolted to the outer surface of each of the side panels 123 and 124 of the chipper housing 120. The shaft 147 extends through one of the side panels 123 of the chipper housing 120 to a belt drive system 186. An electric motor 189 is mounted to a motor support 192 which is fixed to the top panel 127 of the chipper housing 120 and operates the belt drive system 186 which in turn rotates the chipper 140. A belt drive cover panel 195 fits over the belt drive system 186. The electric motor 189 preferably drives the chipper 140 at a speed of about 310 rpm for chipping wax billets, but the appropriate speed of the chipper depends on the type of material being chipped.

The drive gear shaft 47 extends through a bearing (not shown) in the side panel 124 of the chipper housing 120 to a chain drive system 198. The chain drive system is driven by an electric motor 201 mounted to the motor support 192 opposite the other electric motor 189. The electric motor 201 operates the chain drive system 198 through a double reduction gear reducer 204. The chain drive system 198 in turn rotates the drive shaft 47 and the drive sprockets 42 which causes the chains 39 to travel counterclockwise as shown in FIGS. 3A and 3B. Another belt drive cover 207 fits over the chain drive system 198. The electic motor 201 preferably drives the chains 39 at a rate of about 19 inches per minute for wax billets; however, it should be understood that the speed of the chains 39 depends upon the type of material being chipped, the dimensions of the billets, the size and speed of the chipper 140 and the desired rate of chipped material.

An elongated rectangular hold-down plate 220 fits within the rectangular opening 24 in the top panel 21 of the conveyor housing 12 and extends between the front panel 97 of the magazine 53 to the forward end 180 of the dead plate 130. The forward end 223 of the hold-down plate 220 rests on top of stops (not shown) fixed to each of the side panels 123 and 124 of the chipper housing 120 proximate the chipper 140 when there are no billets passing under the forward end of the hold-down plate. The forward end 223 of the hold-down plate 220 rests on top of the billets 113 when the billets pass beneath the forward edge of the hold-down plate. A vertical bar 225 extends upwardly along the forward end 223 of the hold-down plate 220.

Figure 6:
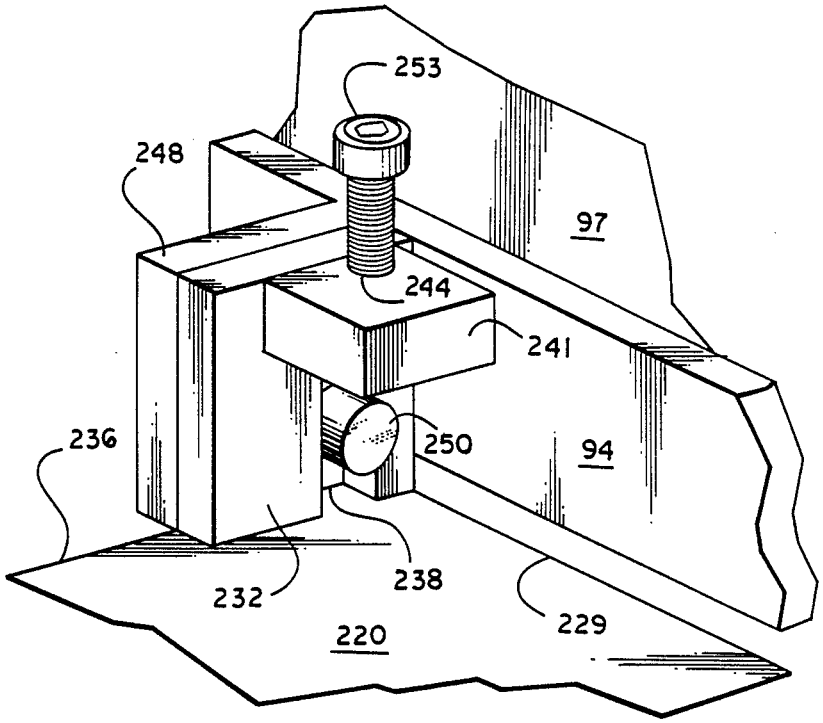
FIG. 6 is a fragmentary perspective view of the preferred embodiment showing the details of the hold-down plate mounted.

The rearward end 229 of the hold-down plate 220 is mounted to the second front panel support bar 94. Rectangular mounts 232 are welded to each side 235 and 236 of the hold-down plate 220 proximate the rearward end 229 and extend upwardly from the hold-down plate as best shown in FIG. 6. Each mount has a central slot 238 and an inwardly extending portion 241 directly above the slot having a vertical bore 244. Rectangular support plates 248 are welded to the second front panel support bar 94 proximate each side 235 and 236 of the hold-down plate 220 and extend from the second front panel support bar toward the hold-down plate. A stop 250 extends inwardly from each of the support plates. The rectangular mounts 232 fit between the rectangular support plates 248 and the stops 250 fit through the central slots 238 of the rectangular mounts. Bolts 253 fit through the vertical bores 244 in each of the rectangular mounts 232 and provide for vertical adjustment of the hold-down plate 220. When the bolts 253 are screwed downwardly, the bolts extend through the vertical bore 244 and contact the stops 250. The bolts 253 push against the stops 250 and raise the hold-down plate 220 upwardly. Likewise, when the bolts 253 are screwed upwardly, the hold-down plate 220 is lowered. The hold-down plate 220 is vertically adjustable so that billets of differing thickness can fit beneath the hold-down plate.

Figure 5:
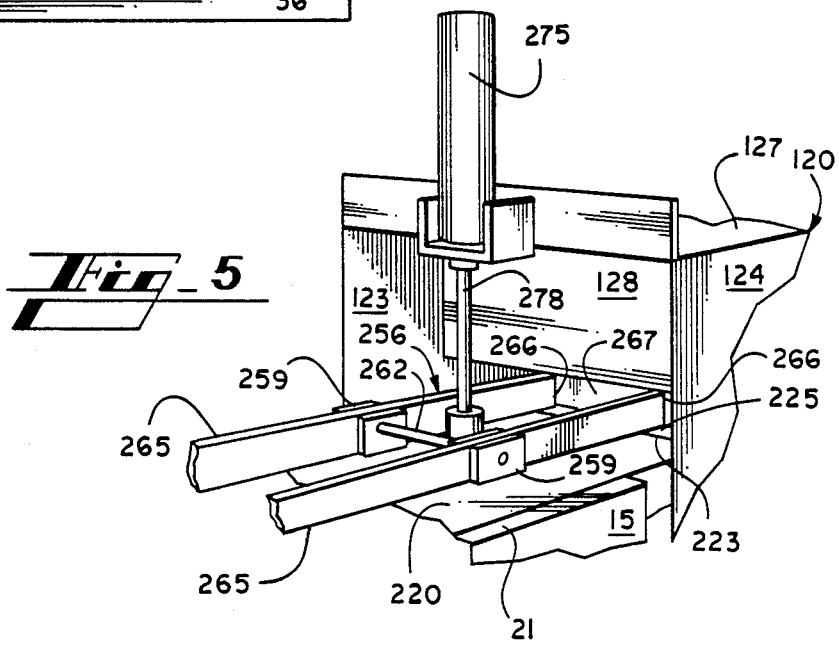
FIG. 5 is a fragmentary perspective view of the preferred embodiment of the present invention illustrating the hold-down plate and the cambering device.

As best shown in FIGS. 1 and 5, a cambering frame 256 is mounted to the top of the hold-down plate 220. The cambering frame 256 includes a pair of brackets 259 opposing one another across the width of the hold-down plate 220 at the midsection of the hold-down plate and fixed to the top of the hold-down plate. Spaced opposing elongated bars 265 run the length of the hold-down plate 220 and fit through respective brackets 259. A shaft 262 extends between the brackets 259 and fits through holes in each of the brackets and the bars 265. The forward ends 266 of the opposing bars 265 are connected by a bar 267 which rests on top on the vertical bar 225 running along the forward end 223 of the hold-down plate 220. The rearward ends of the opposing bars 265 are connected by a horizontal bar 268 having a threaded hole in the center. A bolt 271 fits through the top of the hole in the horizontal bar 268. The cambering frame 256 pivots about the shaft 262 like a see-saw. When the bolt 271 is screwed downwardly through the threaded hole in the horizontal bar 268 the end of the cambering frame proximate the magazine 53 is raised upwardly and the forward end of the cambering frame is forced downwardly against the bar 225 at the forward end 223 of the hold-down plate 220. Accordingly, the forward end 223 of the hold-down plate 220 is forced downwardly against the wax billets 113 as the wax billets pass under the forward end of the hold-down plate and into the chipper 140.

A compressed air cylinder 275 is mounted to the top panel 127 of the chipper housing 120 above the forward end of the hold-down plate 220. Compressed air in the compressed air cylinder 275 forces a shaft 278 extending downwardly from the compressed air cylinder against the top of the hold-down plate 220 and forces the hold-down plate against the billets 113 passing beneath the hold-down plate. The construction of the compressed air cylinder 275 is well known to those skilled in the art and is not discussed herein in detail.

A switch 285 is mounted to the second front panel support bar 91 and is connected to the control box with an electrical cable 290. A probe 288 extends from the switch 285 downwardly to the top of the hold-down plate 220. The probe 288 moves responsive to the vertical movements of the hold-down plate 220. When the hold-down plate 220 is raised above a predetermined level the probe 288 acts to turn the switch 285 off, thereby signalling the control box to shut the operation of the chipping apparatus 10 down. The switch 285 acts as a safety switch, cutting off the chipping apparatus 10 when the traveling billets and flight bars are exposed. Switches such as the switch 285 shown in FIG. 1 are well known to those of ordinary skill in the art and are not discussed here in further detail.

To begin operation of the chipping apparatus 10, billets 113 are stacked horizontally in the magazine 5. The motors 189 and 201 are then turned on to drive the chipper 140 and the chains 39, respectively. As the chains 39 are driven by the drive sprocket 42, the chains travel in the counterclockwise direction as shown in FIGS. 3A and 3B. The first flight bar 50 to reach the stack of billets 113 pushes the billet at the bottom of the stack out from under the stack and slides the billet over the slider bed 36 towards the dead plate 130. Each flight bar 50 pushes another billet 113 out from under the stack of billets when passing beneath the magazine 53. The flight bars 50 push the billets 113 onto the bead plate 130 and into the rotating chipper 140. When the back end of the billet reaches the rearward edge 132 of the dead plate 130, the flight bar 50 passes through the gap between the dead plate and the slider bed 36 and beneath the slider bed towards the idler sprocket 45. Another billet 113 is pushed into the first billet by the following flight bar 50 forcing the remainder of the first billet through the chipper 140. The flight bars 50 continuously feed billets one after the other to the chipper 140.

As shown in FIG. 4A, the cutting edge 159 of the blade 150 shaves into the billet like a wedge and breaks the shaved portion of the billet into chips. The pieces of the billet 113 which have been chipped off fall out of the chipper 140 through the spaces between the blades 150. As shown in FIG. 4B, the trailing edge 165 of each of the blades 150 pushes the billet 113 slightly backwards onto the dead plate 130 as the next blade cuts into the billet. This is particularly advantageous when the last sliver of a billet is being chipped. The cutting edge 159 of each blade 150 tends to flip the last sliver of the billet into the space between the cutting edge of one blade and the back side of the preceding blade and jam the chipper 140. The trailing edge 165, by pushing the last sliver of the billet 113 slightly backwards onto the dead plate 130 ensures that the last sliver of the billet is not flipped into the chipper 140 until the sliver is small enough to be chopped by the succeeding blade.

The chips from the chipper 140 fall downwardly from the chipper. The chipping apparatus 10 is compact and easily fits into most processing lines. For example, when the chipping apparatus 10 is used to chip wax billets, the chipping apparatus can be placed directly above a heating vessel. The chipped wax then falls directly from the chipper 140 into the heating vessel and is quickly melted. Alternatively, the chips from the chipper 140 may be conveyed to the appropriate site.

It should be understood that the foregoing relates only to preferred embodiments of the present invention, and that numerous changes and modifications therein may be made without departing from the spirit and scope of the invention as defined in the following claims.

I claim:

1. Apparatus for chipping billets of solid material, comprising:

a first hub;

a second hub;

a shaft having a longitudinal axis connecting the first hub to the second hub; and a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs, the outer side of each blade facing outwardly from the shaft, the cutting edge of each blade projecting beyond the circular periphery towards the trailing edge of another of said blades, each blade having a plurality of linear grooves in the outer side running between the cutting edge and the trailing edge and spaced from one another along the outer side.

2. Apparatus for chipping billets of solid material, comprising:

a first hub;

a second hub;

a shaft having a longitudinal axis connecting the first hub to the second hub; and a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs, the outer side of each blade facing outwardly from the shaft, the cutting edge of each blade projecting beyond the circular periphery towards the trailing edge of another of said blades, the cutting edge of each blade being positioned a first distance from the longitudinal axis of the shaft, the trailing edge of each blade projecting beyond the circular periphery and being positioned a second distance from the longitudinal axis of the shaft less than the first distance.

3. Apparatus for chipping billets of solid material comprising:

a first hub having a circular first periphery;

a second hub having a circular second periphery;

a shaft connecting the first hub to the second hub; and a plurality of blades, each blade comprising an elongated wedge having a planar outer side which meets a slanted side to form a cutting edge and a back side which meets the outer side opposite the cutting edge to form a trailing edge, each blade mounted between the first hub and the second hub, each blade spaced from one another about the first and second peripheries and spaced from the shaft so that solid material chipped by the blades does not jam between the blades and the shaft, the outer side of each blade positioned tangentially to the first and second peripheries, the cutting edge of each blade projecting beyond the first and second peripheries towards the trailing edge of another of said blades.

4. Apparatus for chipping billets of solid material as in claim 3, wherein the outer side and the slanted side of each blade meet to form an angle from about 35° to about 60°.

5. Apparatus for chipping billets of solid material as in claim 3, wherein each blade has a plurality of linear grooves in the outer side running between the cutting edge and the trailing edge and spaced from one another along the outer side.

6. Apparatus for chipping billets of solid material as in claim 3, wherein:

the circular second periphery has a second center;

the shaft has a longitudinal axis intersecting both the first center and the second center;

the cutting edge of each blade is positioned a first distance from the longitudinal axis of the shaft; and the trailing edge of each blade projects beyond the first and second peripheries and is positioned a second distance from the longitudinal axis of the shaft less than the first distance.

7. Apparatus for chipping billets of solid material as in claim 3, wherein the blades are mounted in notches in both the first periphery and the second periphery.

8. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having a cutting edge and a trailing edge opposite the cutting edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs, the cutting edge of each blade projecting beyond the circular periphery towards the trailing edge of another of said blades;

(c) means positioned proximate the supporting means opposite the chipper for conveying said billets to the supporting means, over the supporting means, and into the chipper, the conveying means comprising:

(i) a slider bed having a forward edge, a rearward edge, and two side edges extending between the forward edge and the rearward edge, the forward edge of the slider bed proximate the supporting means;

(ii) a first endless chain extending along one side edge of the slider bed from the rearward edge of the slider bed to the forward edge of the slider bed;

(iii) a second endless chain extending along the other side of the slider bed from the rearward edge of the slider bed to the forward edge of the slider bed, the second endless chain spaced from the first endless chain so that the billets of solid material fit between the first and second endless chains;

(iv) a flight bar extending between the first chain and the second chain across the slider bed; and (v) means for driving the first and second chains simultaneously so that the flight bar periodically travels over the slider bed and pushes the billets along the slider bed, over the supporting means, and into the chipper, and (d) means operatively associated with the shaft for rotating the chipper whereby said billets are chipped by the cutting edge of each blade as said billets are conveyed into the chipper.

9. Apparatus for chipping billets of solid material as in claim 8, further comprising an elongated hold-down plate having a forward end and a rearward end, the hold down plate positioned above the slider bed with the forward end proximate the chipper and the rearward end proximate the rearward edge of the slider bed to hold the billets against the slider bed and the supporting means as the billets are conveyed over the slider bed, over the supporting means and into the chipper.

10. Apparatus for chipping billets of solid material as in claim 9, further comprising means for cambering the hold-down plate so that the forward end of the hold-down plate is forced downwardly against the billets to hold the billets firmly against the supporting means as the billets contact the chipper.

11. Apparatus for chipping billets of solid material as in claim 8, further comprising a magazine for housing a stack of said billets, the magazine positioned above the slider bed so that the stack of billets rests on top of the slider bed and the flight bar pushes one of the billets out from under the stack of billets each time the flight bar travels over the slider bed.

12. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having a cutting edge and a trailing edge opposite the cutting edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs, the cutting edge of each blade projecting beyond the circular periphery towards the trailing edge of another of said blades;

(c) means positioned proximate the supporting means opposite the chipper for conveying said billets to the supporting means, over the supporting means, and into the chipper, the conveying means comprising:

(i) a slider bed having a forward edge, a rearward edge, and two side edges extending between the forward edge and the rearward edge, the forward edge of the slider bed proximate the supporting means;

(ii) a first endless chain extending along one side edge of the slider bed from the rearward edge of the slider bed to the forward edge of the slider bed;

(iii) a second endless chain extending along the other side of the slider bed from the rearward edge of the slider bed to the forward edge of the slider bed, the second endless chain spaced from the first endless chain so that the billets of solid material fit between the first and second endless chains;

(iv) a plurality of flight bars spaced from one another and extending between the first chain and the second chain across the slider bed; and (v) means for driving the first and second chains simultaneously so that each of the flight bars periodically travel over the slider bed and pushes one of the billets along the slider bed, over the supporting means, and into the chipper; and (d) means operatively associated with the shaft for rotating the chipper whereby said billets are chipped by the cutting edge of each blade as said billets are conveyed into the chipper.

13. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs the outer side of each blade facing outwardly from the shaft, the cutting edge of each blade projecting beyond the circular periphery towards the trailing edge of another of said blades, each blade having a plurality of linear grooves in the outer side running between the cutting edge and the trailing edge and spaced from one another along the outer side;

(c) means positioned proximate the supporting means opposite the chipper for conveying said billets to the supporting means, over the supporting means, and into the chipper; and (d) means operatively associated with the shaft for rotating the chipper whereby said billets are chipped by the cutting edge of each blade as said billets are conveyed into the chipper.

14. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs the outer side of each blade facing outwardly from the shaft, the cutting edge of each blade projecting beyond the circular periphery towards the trailing edge of another of said blades the cutting edge of each blade being positioned a first distance from the longitudinal axis of the shaft, the trailing edge of each blade projecting beyond the circular periphery and positioned a second distance from the longitudinal axis of the shaft less than the first distance;

(c) means positioned proximate the supporting means opposite the chipper for conveying said billets to the supporting means, over the supporting means, and into the chipper; and (d) means operatively associated with the shaft for rotating the chipper whereby said billets are chipped by the cutting edge of each blade as said billets are conveyed into the chipper.

15. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs the outer side of each blade facing outwardly from the shaft, the cutting edge of each blade projecting beyond the circular periphery towards the trailing edge of another of said blades;

(c) means positioned proximate the supporting means opposite the chipper for conveying said billets to the supporting means, over the supporting means, and into the chipper, the conveying means comprising:

(i) a slider bed having a forward edge, a rearward edge, and two side edges extending between the forward edge and the rearward edge, the forward edge of the slider bed proximate the supporting means;

(ii) a first endless chain extending along one side edge of the slider bed from the rearward edge of the slider bed to the forward edge of the slider bed;

(iii) a second endless chain extending along the other side of the slider bed from the rearward edge of the slider bed to the forward edge of the slider bed, the second endless chain spaced from the first endless chain so that the billets of solid material fit between the first and second endless chains;

(iv) a flight bar extending between the first chain and the second chain across the slider bed; and (v) means for driving the first and second chains simultaneously so that the flight bar periodically travels over the slider bed and pushes the billets along the slider bed, over the supporting means, and into the chipper; and (d) means operatively associated with the shaft for rotating the chipper whereby said billets are chipped by the cutting edge of each blade as said billets are conveyed into the chipper.

16. Apparatus for chipping billets of solid material as in claim 15, further comprising an elongated hold-down plate having a forward end and a rearward end, the hold down plate positioned above the slider bed with the forward end proximate the chipper and the rearward end proximate the rearward edge of the slider bed to hold the billets against the slider bed and the supporting means as the billets are conveyed over the slider bed, over the supporting means and into the chipper.

17. Apparatus for chipping billets of solid material as in claim 16, further comprising means for cambering the hold-down plate so that the forward end of the hold-down plate is forced downwardly against the billets to hold the billets firmly against the supporting means as the billets contact the chipper.

18. Apparatus for chipping billets of solid material as in claim 15, further comprising a magazine for housing a stack of said billets, the magazine positioned above the slider bed so that the stack of billets rests on top of the slider bed and the flight bar pushes one of the billets out from under the stack of billets each time the flight bar travels over the slider bed.

19. Apparatus for chipping billets of solid material, comprising:

(a) means for supporting said billets;

(b) a chipper positioned proximate the supporting means, the chipper comprising:

(i) a first hub;

(ii) a second hub;

(iii) a shaft having a longitudinal axis connecting the first hub to the second hub; and (iv) a plurality of blades, each blade comprising an elongated member having an outer side which meets a slanted side to form a cutting edge and a back side which meets the outer side opposite the cutting edge to form a trailing edge, each blade mounted between the first hub and the second hub, each blade spaced from one another along a circular periphery about the shaft and spaced from the shaft so that solid material chipped by the blades does not jam between the blades and the shaft, the circular periphery having a center through which the longitudinal axis of the shaft runs the outer side of each blade facing outwardly from the shaft, the cutting edge of each blade projecting beyond the circular periphery towards the trailing edge of another of said blades;

(c) means positioned proximate the supporting means opposite the chipper for conveying said billets to the supporting means, over the supporting means, and into the chipper, the conveying means comprising:

(i) a slider bed having a forward edge, a rearward edge, and two side edges extending between the forward edge and the rearward edge, the forward edge of the slider bed proximate the supporting means;

(ii) a first endless chain extending along one side edge of the slider bed from the rearward edge of the slider bed to the forward edge of the slider bed;

(iii) a second endless chain extending along the other side of the slider bed from the rearward edge of the slider bed to the forward edge of the slider bed, the second endless chain spaced from the first endless chain so that the billets of solid material fit between the first and second endless chains;

(iv) a plurality of flight bars spaced from one another and extending between the first chain and the second chain across the slider bed; and (v) means for driving the first and second chains simultaneously so that each of the flight bars periodically travel over the slider bed and pushes one of the billets along the slider bed, over the supporting means, and into the chipper; and (d) means operatively associated with the shaft for rotating the chipper whereby said billets are chipped by the cutting edge of each blade as said billets are conveyed into the chipper.

20. Apparatus for chipping billets of solid material, comprising:

(a) means for supporting said billets;

(b) a chipper positioned proximate the supporting means, the chipper comprising:

(i) a first hub having a circular first periphery;

(ii) a second hub having a circular second periphery;

(iii) a shaft connecting the first hub to the second hub; and (iv) a plurality of blades, each blade comprising an elongated wedge having a planar outer side which meets a slanted side to form a cutting edge and a back side which meets the outer side opposite the cutting edge to form a trailing edge, each blade mounted between the first hub and the second hub and, each blade spaced from one another about the first and second peripheries and spaced from the shaft so that solid material chipped by the blades does not jam between the blades and the shaft, the outer side of each blade positioned tangentially to the first and second peripheries, the cutting edge of each blade projecting beyond the first and second peripheries towards the trailing edge of another of said blades;

(c) means positioned proximate the supporting means opposite the chipper for conveying said billets to the supporting means, over the supporting means, and into the chipper; and (d) means operatively associated with the shaft for rotating the chipper whereby said billets are chipped by the cutting edge of each blade as said billets are conveyed into the chipper.

21. Apparatus for chipping billets of solid material as in claim 20, wherein the outer side and the slanted side of each blade meet to form an angle from about 35° to about 60°.

22. Apparatus for chipping billets of solid material as in claim 20, wherein each blade has a plurality of linear grooves in the outer side running between the cutting edge and the trailing edge and spaced from one another along the outer side.

23. Apparatus for chipping billets of solid material as in claim 20 wherein:

the circular first periphery has a first center;

the circular second periphery has a second center;

the shaft has a longitudinal axis intersecting both the first center and the second center;

the cutting edge of each blade is positioned a first distance from the longitudinal axis of the shaft; and the trailing edge of each blade projects beyond the first and second peripheries and is positioned a second distance from the longitudinal axis of the shaft less than the first distance.

24. Apparatus for chipping billets of solid material as in claim 20, wherein the blades are mounted in notches in both the first periphery and the second periphery.

25. Apparatus for chipping billets of solid material as in claim 20, wherein the conveying means comprises:

a slider bed having a forward edge, a rearward edge, and two side edges extending between the forward edge and the rearward edge, the forward edge of the slider bed proximate the supporting means;

a first endless chain extending along one side edge of the slider bed from the rearward edge of the slider bed to the forward edge of the slider bed;

a second endless chain extending along the other side of the slider bed from the rearward edge of the slider bed to the forward edge of the slider bed, the second endless chain spaced from the first endless chain so that the billets of solid material fit between the first and second endless chains;

a flight bar extending between the first chain and the second chain across the slider bed; and means for driving the first and second chains simultaneously so that the flight bar periodically travels over the slider bed and pushes the billets along the slider bed, over the supporting means, and into the chipper.

26. Apparatus for chipping billets of solid material as in claim 25, further comprising an elongated hold-down plate having a forward end and a rearward end, the hold down plate positioned above the slider bed with the forward end proximate the chipper and the rearward end proximate the rearward edge of the slider bed to hold the billets against the slider bed and the supporting means as the billets are conveyed over the slider bed, over the supporting means and into the chipper.

27. Apparatus for chipping billets of solid material as in claim 26, further comprising means for cambering the hold-down plate so that the forward end of the hold-down plate is forced downwardly against the billets to hold the billets firmly against the supporting means as the billets contact the chipper.

28. Apparatus for chipping billets of solid material as in claim 25 further comprising a magazine for housing a stack of said billets, the magazine positioned above the slider bed so that the stack of billets rests on top of the slider bed and the flight bar pushes one of the billets out from under the stack of billets each time the flight bar travels over the slider bed.

29. Apparatus for chipping billets of solid material as in claim 20, wherein the conveying means comprises:

a slider bed having a forward edge, a rearward edge, and two side edges extending between the forward edge and the rearward edge, the forward edge of the slider bed proximate the supporting means;

a first endless chain extending along one side edge of the slider bed from the rearward edge of the slider bed to the forward edge of the slider bed;

a second endless chain extending along the other side of the slider bed from the rearward edge of the slider bed to the forward edge of the slider bed, the second endless chain spaced from the first endless chain so that the billets of solid material fit between the first and second endless chains;

a plurality of flight bars spaced from one another and extending between the first chain and the second chain across the slider bed; and means for driving the first and second chains simultaneously so that each of the flight bars periodically travel over the slider bed and pushes one of the billets along the slider bed, over the supporting means, and into the chipper.

* * * * *